US005111651A

United States Patent [19]

Pohn et al.

[11] Patent Number: 5,111,651

[45] Date of Patent: May 12, 1992

[54] OPEN-END SPINNING DEVICE

[76] Inventors: Johann Pohn, Ziegeleistr. 45; Romeo Pohn, Weicheringerstr. 142, both of, D-8070 Ingolstadt, Fed. Rep. of Germany

[21] Appl. No.: 550,391

[22] Filed: Jul. 10, 1990

[30] Foreign Application Priority Data

Jul. 13, 1989 [DE] Fed. Rep. of Germany ..... 3923060

[51] Int. Cl.[5] ..... D01H 7/882; D01H 4/30

[52] U.S. Cl. ..... 57/413; 57/411

[58] Field of Search ..... 57/413, 400, 404, 407, 57/413, 411, 415, 416, 417, 301, 405, 406, 408

[56] References Cited

U.S. PATENT DOCUMENTS 3,785,138 1/1974 Rajnoha et al. ..... 57/413
3,901,013 8/1975 Scharychenkov ..... 57/413
3,924,397 12/1975 Stahlecker et al. ..... 57/56
4,014,162 3/1977 Stahlecker ..... 57/413
4,479,348 10/1984 Yasui et al. ..... 57/404
4,567,722 2/1986 Stahlecker ..... 57/401
4,638,626 1/1987 Stahlecker et al. ..... 57/401
4,653,266 3/1987 Dexler et al. ..... 57/407

*Primary Examiner*—Daniel P. Stodola
*Assistant Examiner*—John F. Rollins
*Attorney, Agent, or Firm*—Dority & Manning

[57] ABSTRACT

An open-end spinning device with a fiber feeding channel which extends from a housing with a rotating opening roller to a spinning element. The fiber feeding channel comprises two channel sections which can be moved towards each other and can be brought into alignment with each other. The first channel section is located in an insert of the housing and is capable of axial movement in the housing. The insert is urged by an elastic element in the direction of the second channel section and is covered by a screen on its end towards the interior of the housing, at least on the downstream side (with reference to the rotational direction of the opening roller). A seal is located between the insert and the housing.

13 Claims, 2 Drawing Sheets

OPEN-END SPINNING DEVICE

BACKGROUND OF THE INVENTION

The instant invention relates to an open-end spinning device with a spinning element, a housing for a rotatable opening roller and a fiber feeding channel extending from the housing to the spinning element and consisting of two channel sections which can be moved together and aligned with each other.

In known devices of this type an elastic ring seal is installed in one of the two end surfaces facing each other (see German Pat. No. DE 3,512,591 A1and U. S. Pat. No. 4,693,266). Due to its elasticity, this seal ensures that permissible variations in the movement of the second channel section in relation to the first channel section are absorbed, with this ring seal ensuring tightness independently of these variations. However, this ring seal holds the opposing end surfaces of the two channel sections at a distance from each other so that a gap is produced between the two channel sections into which fibers can penetrate and where they can become stuck. An occurring static charge further increases this danger. These fibers are loosened from time to time and reach the spinning element in form of fiber clots, leading to faults in the form of thickening in the yarn or to yarn breakage.

SUMMARY OF THE INVENTION

It is, therefore, an object of the instant invention to provide an improved device of this type so that fibers cannot become caught between the two channel sections while the point of separation is perfectly sealed.

This object is attained by the instant invention in that an axially movable insert is placed in the housing, the insert receiving the first channel section is pressed against the second channel section by an elastic or resilient element when the channel sections are aligned with each other, the insert is covered by a screen at its end towards the inside of the housing, at least on the downstream side (in relation to the opening roller's direction of rotation). The two channel sections are brought into bearing contact with each other so that no gap is produced between them. Therefore, no fibers can be caught there. Irregularities in the yarn produced and/or yarn breakage are thus avoided. The adherence of the two channel sections against each other is ensured by the elastic element which presses the insert against the second channel section. The end of the insert towards the interior of the housing is covered at least in its endangered area so that no fibers can penetrate into the gap between the cover and the insert. To assist this effect, a seal can be provided between the insert and the housing in an advantageous further embodiment of the invention. This prevents any air flow from occurring in the gap in the area of the insert end towards the opening roller, since the interior of the fiber feeding channel is sealed off against the outer atmosphere by the seal placed between insert and housing.

When the two channel sections are properly adjusted in relation to each other it may suffice to position the seal movably in the axial direction only within the opening roller housing. If, however, greater tolerances apply, a further advantageous embodiment of the object of the invention provides for the insert to be movable not only in the axial direction but also radially in the opening roller housing, with the seal being made in the form of a radial seal. In this manner, the insert is able to carry out slight tilting movements in the opening roller housing and can thus adapt to the second channel section. This type of support of the insert in the housing is achieved preferably by giving the insert as well as the housing cylindrical guiding surfaces through which the insert is guided with some clearance, while the seal is installed between these cylindrical guiding surfaces.

In an advantageous embodiment of the device according to the instant invention, it is possible to provide the insert on its outside with a radial surface which faces the housing while the elastic element is made in form of a spring washer placed between the radial surface of the insert and a radial surface of the housing.

In order to achieve especially good sealing pressure between the two channel section it is advantageous to make the front surfaces of the channel sections facing each other in form of uninterrupted smooth sealing surfaces.

The axially elastic support of the insert can also be obtained by means of elastic elements of different design. In a preferred embodiment the insert is provided with a supporting surface for the elastic element on its end away from the second channel section.

It is not necessary for the seal and the elastic element to consist of two separate parts. In another advantageous embodiment of the device, according to invention, the insert is provided outside the housing with a radial surface facing the housing while the elastic element is constituted by the seal installed between the radial surface of the insert and a radial surface of the housing.

To ensure that the insert cannot change its rotational position with respect to the housing, a situation which could impair the tightness between the two channel sections, it is advantageous to provide the housing with an anti-rotation safety for the insert.

The screen used to cover the end of the insert towards the opening roller can be designed in different ways. In a preferred embodiment of the invention the screen is made in form of a liner which covers at least part of the interior wall of the housing. In another advantageous embodiment of the screen, it is constituted by a housing part extending all the way into the insert.

The device, according to the instant invention, is of simple construction and makes it possible for the insert to be replaced rapidly if it should become unserviceable due to wear. Furthermore, this rapid and easy replaceability also makes it possible to adapt easily to different fiber feeding channels that may become necessary when a spinning element is replaced. Furthermore, catching of fibers in the fiber feeding channel on their way between the opening roller housing and the spinning element is reliably prevented so that the danger of resulting fiber accumulations no longer exists. Irregularities in the yarn or yarn breakage due to such fiber accumulations are thus avoided. A perfect seal of the fiber feeding channel against outer air is, nevertheless, ensured so that the conveying of the fibers is not impaired.

BRIEF DESCRIPTION OF THE DRAWINGS

The invention is explained below through the drawings.

DETAILED DESCRIPTION OF THE INVENTION

The invention is explained below, through the example of a spinning device 1 provided with a spinning rotor 10 as its spinning element, but the invention can also be used with other types of openend spinning device, e.g., friction spinning devices.

Figure 1:
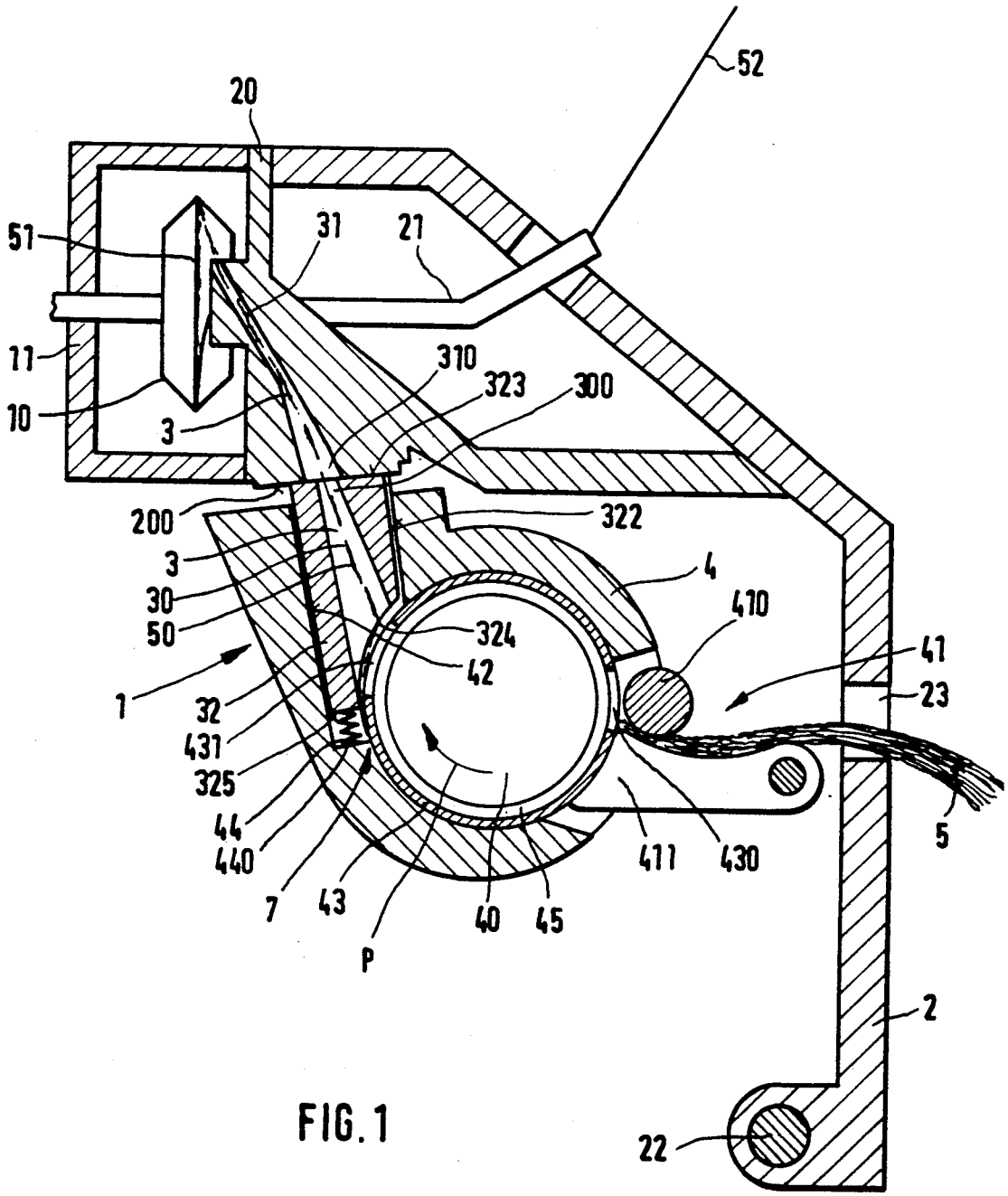
FIG. 1 is a section view through an open-end spinning device according to the instant invention.

According to FIG. 1, the spinning rotor 10 is located rotatably in a housing 11. The rotor can be covered by a cover 20 which is supported by a swiveling cover 2 covering the different parts of the spinning device 1. Cover 2 is pivotably mounted on a swivel axle 22 so that the cover 20 can be swiveled away from housing 11. Cover 20 receives a yarn drawoff pipe 21 and a section of a fiber feeding channel 3, to be described in greater detail further below.

As shown in FIG. 1, the fiber feeding channel 3 is subdivided into two channel sections 30 and 31 of which the first channel section 30 is installed in an insert 32, and the second channel section 31 is installed in cover 20. The insert 32 is placed in a housing 4 containing a driven opening roller 40 in such manner as to be axially mobile. The opening roller 40 is preceded by a feeding device 41 equipped, in the embodiment shown, in the usual manner with a driven supply roller 410 with which a feeding trough 411, subjected to an elastic force, interacts.

The opposing end surfaces of the elements receiving the two channel sections 30 and 31, i.e., the end surfaces of insert 32 and cover 20 which face each other are made in form of uninterrupted smooth and even sealing surfaces 200 and 323 so that when they are pressed against each other, fibers 50 cannot come between these sealing surfaces 200 and 323. The inlet opening 310 of channel section 31 is, furthermore, larger than the outlet opening 300 of channel section 30 as is customary so as to avoid any edges extending into the fiber feeding channel 3 on which fibers 50 may catch.

The insert 32 has a cylindrical outer contour in form of a guiding surface 322 and is placed in housing 4 with some radial clearance. To this effect, the housing 4 is provided with a cylindrical recess in form of a guiding surface 42 for the insert 32.

The housing 4 is provided with a screen made in form of a liner 43 which covers the entire interior circumference of housing 4 and only leaves an opening 431 free in the area of the feeding device 41 and an opening 430 in the area of the fiber feeding channel. Opening 430 makes its possible to feed a fiber sliver 5 to the opening roller 40 while opening 431 enables fibers 50 to go from the interior of housing 4 into fiber feeding channel 3. This liner 43 covers the end of the insert 32 towards the opening roller 40 on its downstream side (with reference to arrow P). On the upstream side the channel section 30 is also somewhat covered and thus separates a recess 44 from the interior space 45 in which the opening roller 40 is located. This recess 44 receives a supporting surface 325 which is located on the end of insert 32 furthest from the channel section 31, e.g., in form of a compression spring 440 bearing on this supporting surface 325 and on a wall of recess 44. In the shown position of cover 2, the fiber sliver 5 is presented to the feeding device 41 through an opening 23 in cover 2. Feeding device 41 feeds the fiber sliver 5 to the opening roller 40. The opening roller 40, which rotates in the direction of arrow P, combs fibers 50 out of the leading end of the fiber sliver 5, fibers 50 enters fiber feeding channel 3 and goes from there into the spinning rotor 10 where they are deposited in a fiber collection groove and there constitute a fiber ring 51. The end of a yarn 52 is in contact with the fiber ring 51 and is drawn off continuously by a draw-off device (not shown) and, in this process, incorporates fiber ring 51 into its end for the continuous formation of yarn 52.

When a yarn breaks or when the spinning process is interrupted for some other reason the cover 2 is swung open on housing 11. This renders the spinning rotor 10 accessible. Furthermore, the channel section 31 located in the cover 20 frees the end of channel section 30 away from the opening roller 40.

If the spinning device 1 is to be restarted after a stoppage, the cover 2 is returned, in a known manner, into its operating position shown in FIG. 1 to carry out the piecing operation. In that case, the cover 20 presses with its sealing surface 200 against the sealing surface 323 of the insert 32. The two channel sections 30 and 31 are then again aligned with each other, with insert 32 together with the channel section being held in contact with 31 on the cover 20 by the elastic element (compression spring 440).

As shown in FIG. 1, the insert 32 is installed in housing 4 so as to be movable in the axial direction and the second channel section 31 is pressed against it by the elastic element (compression spring 440) in the direction of cover 20. The end surface of insert 32 towards the opening roller 40 is covered as mentioned, at least on its downstream side (see conveying direction indicated by arrow P) by screen 43 so that even when insert 32 is moved slightly away from the opening roller 40, fibers 50 cannot enter the gap 324 between insert 32 and screen 43. The compression spring 440 is shielded off by screen 43 so that no fibers 50 can become attached to it.

Due to the radial clearance between the guiding surfaces 42 and 322, insert 32 can adapt its position to cover 20 so that the opposing sealing surfaces 200 and 323 of insert 32 which receives channel section 30 and of cover 20 which receives the channel section 31 are in sealing contact with each other.

The sealing surfaces 200 and 323 can be made in different ways; it is only necessary that no gap exists between them in the area of transition from channel section 30 to channel section 31.

Various designs are possible for the sealing surfaces 200 and 323, for instance in form of labyrinth seals, also avoiding a gap on its radial interior side.

With proper orientation of the sealing surfaces 200 and 323 and appropriate placement of the swivel axle 22 of the cover 2 it may suffice for insert 32 to be movable only in the axial direction.

The described device can be varied in many ways, in particular by replacing different characteristics with equivalents or through different combinations of the characteristics described. Thus, it is not necessary for the elastic element to be a compression spring 44 as shown in FIG. 1 and to be installed at the end of insert 32 furthest from the second channel section 31. In the embodiment shown in FIG. 2 the insert 32 is provided with a radial surface 320 outside housing 4 which is facing housing 4. The housing is provided with a similar radial surface 46 which is across from the radial surface 320 of the insert 32. A spring washer 460 is located between these two radial surfaces. A seal in form of a packing ring 6 is, furthermore, provided between the cylindrical guiding surfaces 322 and 42, the packing ring being secured axially in the conventional manner by a groove 422. Packing ring 6 can, of course, also be placed in a circumferential groove (not shown) of insert 32 if desired.

Figure 2:
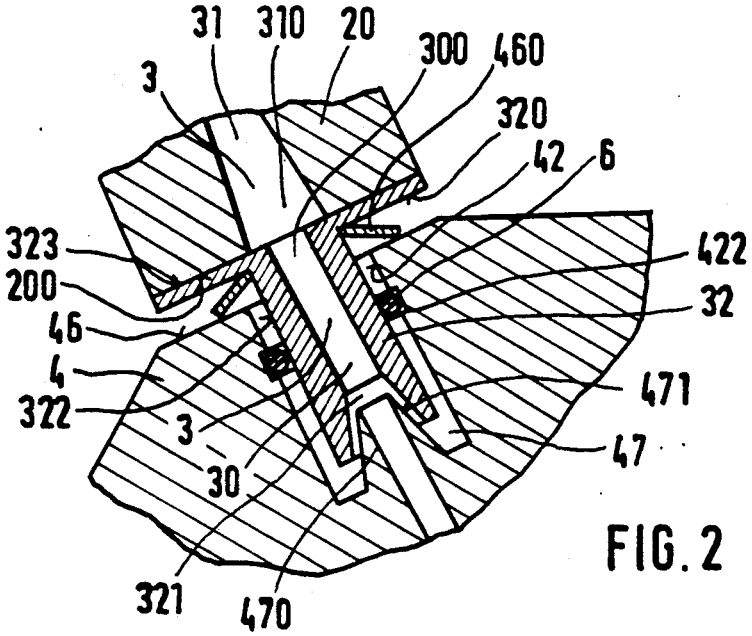
FIG. 2 is a detailed section of a fiber feeding channel according to the invention in a different embodiment.

The function of the device shown in FIG. 2 is the same as that of the device shown in FIG. 1. Insert 32 is sealed against housing 4 at its circumference by the packing ring 6 so that dead air cannot enter here. This produces a neutral flow zone at that location due to the seal between insert 32 and housing 4 constituted by packing ring 6. The consequence of this is that not only the covering of gap 324 between insert 32 and screen 43, but this neutral flow zone also ensures that no fibers become caught.

If desired, and if the axial mobility of insert 32 is not impaired by it, the packing ring 6 constituting a radial seal can be completed by an additional packing ring (not shown), with insert 32 being only capable of minimal radial movement.

Figure 3:
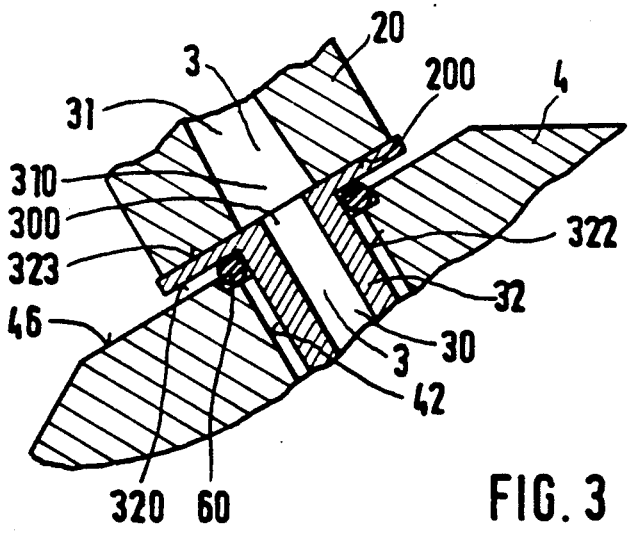
FIG. 3 is a detailed section view of yet another embodiment of the fiber feeding channel according to the instant invention.

FIG. 3 shows another embodiment of the device according to invention in which insert 32 is again provided with a radial surface 320 and housing 4 with a radial surface 46. In this case a seal 60 provides a seal between housing 4 and insert 32 on the one hand and is made in form of an elastic element, on the other hand, exerting pressure in the axial direction on insert 32, pressing it in the direction of channel section 31. This design produces, in principle, the same function as in the designs described earlier through FIGS. 1 and 2.

Seal 6 or 60 causes inert 32 to be positioned in housing 4 so that any danger of shifting due to rotation is substantially prevented. This is especially true when the sealing surfaces 200 and 323 are oriented transversely with respect to the longitudinal axis of insert 32, since the sealing effect is thereby ensured equally in any rotated position of insert 32.

In order to render rotation entirely impossible, however, as is especially important for the passage from the interior space 45 of housing 4 into the channel section 30, an anti-rotation system 7 can be provided for the insert 32 (see FIG. 1). The antirotation system 7 can consist in the fact that insert 32 and housing 4 are other than circular in form and are provided with interacting guiding surfaces, for example. For that purpose the anti-rotation device 7 is constituted according to FIG. 1 by the interacting surfaces of insert 32 and liner 43. By setting cover 20 on insert 32 the latter is pressed against the force of the elastic element (e.g., compression spring 440, hydraulic piston, etc.) in direction of opening roller 40, while insert 32 is being turned back into its correct rotational position if it should have become slightly twisted.

In some cases an axial groove can also be provided, in which a radially projecting extension projects so that it is guided in this axial groove (not shown), it is, in principle, unimportant whether the axial groove is in the housing and the stop on the insert or vice versa. Care must, however, be taken that the sealing effect is not affected by this. If insert 32 is secured against rotation it always assumes its optimal position with respect to cover 20 and channel section 31, thus ensuring a perfect seal at the transition from channel section 30 into channel section 31.

Screen 43 need not be made in form of a housing liner extending over the entire inner circumference of housing 4. It is sufficient if it extends merely over the endangered area of insert 32. Depending on the design of insert 32, screen 43 need not cover insert 32 upstream of the feeding channel 3, or need to cover it only partially.

It is also possible to constitute the screen by a portion of housing 4 itself. According to FIG. 2 this housing portion extends all the way into insert 32. The latter ends in a ring groove 47 on its end towards opening roller 40, from which a nozzle-shaped pipe connection 470 extends into the interior of insert 32 which thus constitutes the screen and carries out its function.

To avoid an excessive jump in diameter at the free end of the pipe connection 470, insert 32 can be provided with a conical widening 321 on its inside, on the side of the opening roller, and the pipe connection 470 can be conically tapered on its outer circumference on the side of the insert.

The arrangement described also ensures that fibers 50 cannot become caught as they pass into channel section 30 and then come loose at some time in form of fiber clots which may enter the spinning rotor.

It is, of course, possible, when the screen is designed in form of a pipe connection 470 extending into the insert, to install the elastic element (in the form of a helical spring or also spring washer) which exerts its force in the ring groove 47.

We claim:

1. An open-end spinning device having a spinning element disposed within a spinning housing and a rotatable fiber opening roller disposed within an opening roller housing, connected by a fiber feeding channel, said fiber feeding channel comprising:

a) a first feeding channel section disposed within said opening roller housing for receiving opened fiber from said opening roller;

b) a cover for closing said spinning housing;

c) a second feeding channel section disposed within said cover for receiving fiber from said first feeding channel section when said cover is closed;

d) said first feeding channel section being defined by an insert;

e) means for supporting said insert for movement along its longitudinal axis;

f) mating interfacing surfaces surrounding adjacent ends of said first and second feeding channel sections for abutting contact with each other when said cover is closed; and g) resilient means for urging said insert supported for movement into abutting contact with the other section when said cover is closed.

2. A device as set forth in claim 1, wherein said insert is located within said opening roller housing and further comprises a pneumatic seal between said insert and said opening roller housing.

3. A device as set forth in claim 2, wherein said insert is supported within said opening roller housing for movement along its longitudinal axis and said seal is radially disposed about said insert.

4. A device as set forth in claim 2, wherein said insert comprises a radial surface outside of said opening roller housing and said resilient element comprises a pneumatic seal disposed between said radial surface of said insert and the outer surface of said opening roller housing.

5. An open-end spinning device having a spinning element disposed within a spinning housing and a rotatable fiber opening roller disposed within an opening roller housing, connected by a fiber feeding channel, said fiber feeding channel comprising:

a) an axially movable insert disposed within said opening roller housing having a first channel section disposed therein to receive fiber from said opening roller;

b) a cover for closing said spinning housing have a second channel section disposed therein for receiving fiber from said first channel section and for directing said fiber to said spinning element when said cover is closed with said first and second channel sections in abutting contact;

c) mating interface surfaces on said first and second channel sections where said channel sections abut; and d) resilient means for urging said first channel section towards said second channel section along its longitudinal axis.

6. A device as set forth in claim 5, wherein a pneumatic seal is disposed between said insert and said opening roller housing.

7. A device as set forth in claim 5, wherein said insert is cylindrical and is disposed within a cylindrical opening in said opening roller housing and a pneumatic seal is disposed between the outer surface of said insert and the inner surfaces of said cylindrical opening in said opening roller housing.

8. A device as set forth in claim 5, wherein one end of said insert is disposed outside of said opening roller housing and comprises a radial surface having a greater diameter than said cylindrical opening in said opening roller housing and said resilient means comprises a spring washer disposed between said radial surface of said insert and the outer surface of said opening roller housing.

9. A device as set forth in claim 5, wherein said mating interface surfaces are smooth.

10. A device as set forth in claim 5, wherein said insert comprises a supporting surface at its end furthest from said second channel section for said resilient means.

11. A device as set froth in claim 5, wherein said opening roller housing comprises means for holding said insert against rotation within said opening roller housing.

12. A device as set forth in claim 5, wherein a screen liner covers at least a part of the interior wall of said opening roller housing.

13. A device as set forth in claim 5, wherein a portion of said opening roller housing comprises a screen which extends into a portion of said insert.

* * * * *